US005816076A

United States Patent [19]

Biedermann et al.

[11] Patent Number: 5,816,076

[45] Date of Patent: Oct. 6, 1998

[54] COMPUTER SECURITY APPARATUS

[75] Inventors: David A. Biedermann; Reynold Liao, both of Austin, Tex.

[73] Assignee: Dresser Industries, Inc., Dallas, Tex.

[21] Appl. No.: 768,026

[22] Filed: Dec. 13, 1996

[51] Int. Cl.[6] ..... E05B 73/00

[52] U.S. Cl. ..... 70/57; 70/58; 70/159; 70/164; 70/258; 248/552; 312/245

[58] Field of Search ..... 70/159, 164, 58, 70/63, 57, 62, 158, 258, 160–163, 166–169; 292/17; 248/551, 552, 553; 312/245, 246; 109/50, 51

[56] References Cited

U.S. PATENT DOCUMENTS

| | | | |
|---|---|---|---|
| 1,102,869 | 7/1914 | Carmer et al. | 312/245 X |
| 1,636,697 | 7/1927 | Larson et al. | 292/17 X |
| 1,758,843 | 5/1930 | Lizotte | 312/245 X |
| 1,906,306 | 5/1933 | Boesel | 312/245 X |
| 1,944,687 | 1/1934 | Henderson | 312/245 X |
| 3,081,056 | 3/1963 | Young et al. | 248/552 |
| 3,487,446 | 12/1969 | Hero et al. | 312/245 X |
| 3,945,227 | 3/1976 | Reiland | 70/58 |
| 4,052,867 | 10/1977 | Faunce | 70/58 |
| 4,289,238 | 9/1981 | Warncke et al. | 312/245 X |
| 4,370,935 | 2/1983 | Link | 109/74 X |
| 4,556,188 | 12/1985 | Allison, Jr. | 248/553 |
| 4,561,705 | 12/1985 | Schäfer | 312/245 X |
| 4,573,332 | 3/1986 | Ma | 70/63 X |
| 4,600,249 | 7/1986 | Anderson | 312/196 |
| 4,656,848 | 4/1987 | Rose | 70/58 |
| 4,929,039 | 5/1990 | Thomas et al. | 312/245 X |
| 5,162,976 | 11/1992 | Moore et al. | 70/58 X |
| 5,188,403 | 2/1993 | Anderson | 292/17 |
| 5,381,685 | 1/1995 | Carl et al. | 70/58 |
| 5,406,809 | 4/1995 | Igelmund | 70/2 |
| 5,502,989 | 4/1996 | Murray et al. | 70/58 |

FOREIGN PATENT DOCUMENTS

| | | | |
|---|---|---|---|
| 1349485 | 4/1974 | United Kingdom | 292/17 |

*Primary Examiner*—Lloyd A. Gall
*Attorney, Agent, or Firm*—Haynes and Boone, L.L.P.

[57] ABSTRACT

A computer security apparatus is disclosed. In a departure from the art, a metal box having a padlocked front closure is used to mount a computer to the underside of a surface, such as a counter or desk top, in such a manner as to prevent unauthorized access to and removal of the computer. In a preferred embodiment, the security device of the present invention comprises a substantially rectangular-shaped metal housing having a top, opposing left and right sides, and a door hingedly connected across the front of the housing. Each of the left and right sides includes a rear flange extending approximately one quarter of the way across the rear of the housing and a bottom flange extending approximately one third of the way across the bottom of the housing for securing the rear and bottom sides of the computer, respectively. Spaced-apart clips are provided along one end of the door for securing the door to the front end of one of the opposing sides. A forwardly projecting flange having an aperture therethrough is positioned between the clips such that when the door is closed and the clips are in place, the aperture in the flange is aligned with a corresponding aperture in the front end of the respective opposing side for enabling a padlock to be passed therethrough, thus locking the door to the housing. A mounting apparatus is provided on the top of the housing for securing the apparatus beneath a work surface.

24 Claims, 2 Drawing Sheets

COMPUTER SECURITY APPARATUS

BACKGROUND OF THE INVENTION

The invention relates generally to apparatus for ensuring the physical security of a computer device and, more particularly, to an apparatus for preventing a computer installed in a public location from being removed or tampered with.

With the burgeoning use of personal computers in public locations, such as gas stations and convenience stores, has come difficulties associated with providing security against theft thereof and tampering therewith. A number of different types of devices for securing a computer to a surface, such as a counter or desk top, are known. Usually, such devices include a bolt which is installed from the interior of the computer chassis downward into a table top. Clearly, this requires the computer chassis to be disassembled before the computer can be "locked" and subsequently "unlocked" from the table top.

Security devices that require complete or partial disassembly of a computer chassis before the computer can be installed on or removed from the surface to which it is secured suffer from several deficiencies, the most obvious of which is the fact that they require the repeated exposure of the computer's complicated and often delicate circuitry to possible damage.

Alternatively, cables that attach at one end to the computer and at another end to a work surface may be provided for securing the computer to the surface. The principal deficiency associated with such systems is the difficulty in effectively and conveniently attaching the cable to the computer itself. In addition, such cables are not altogether invulnerable to being severed; therefore, they do not provide a great deal of security against theft. In addition, neither of the systems discussed above provides any security against tampering.

Therefore, what is needed is an apparatus for preventing unauthorized persons from removing or tampering with a computer installed in a public location that does not require the computer chassis to be disassembled during installation thereof.

SUMMARY OF THE INVENTION

The foregoing problems are solved and a technical advance is achieved by apparatus for securing a computer installed in a public location, such as a gas station or convenience store. In a departure from the art, a metal box having a padlocked front closure is used to mount a computer to the underside of a surface, such as a counter or desk top, in such a manner as to prevent unauthorized access to and removal of the computer.

In a preferred embodiment, the security device of the present invention comprises a metal housing having a substantially rectangular-shaped cross-section and comprising a top, opposing left and right sides, and a door hingedly connected across the front of the housing. Each of the left and right sides includes a rear flange extending approximately one quarter of the way across the rear of the housing and a bottom flange extending approximately one third of the way across the bottom of the housing for securing the rear and bottom sides of the computer, respectively, within the housing while simultaneously providing ventilation for dissipating heat generated by the computer when in use. Openings for providing additional ventilation are provided in the left and right opposing sides.

In one aspect of the invention, a pair of spaced-apart clips are provided along the end of the door opposite the hinge for securing the door to the front end of one of the opposing sides. A first forwardly projecting flange having an circular aperture provided therethrough is positioned between the clips such that when the door is closed and the clips are in place, the aperture in the flange is aligned with a corresponding circular aperture in the front end of the respective opposing side for enabling a padlock to be passed therethrough, thus locking the door to the housing.

In another aspect of the invention, a mounting apparatus comprising two pairs of protuberances is provided on the top of the housing. One pair of protuberances each include a slotted opening having a circular portion for receiving the head of a screw partially screwed into the underside of a surface to which the apparatus is to be mounted and an elongated portion for retaining the screw head when the apparatus is moved in a direction opposite the elongated portion. The other pair of protuberances each include a threaded bore for receiving a screw to secure the housing in place with respect to the underside of the surface.

In yet another aspect of the invention, a second forwardly projecting flange extends substantially the length of the top edge of the door for preventing access to the computer via any space that may otherwise exist between the top edge of the door and the front edge of the top of the housing.

A technical advantage achieved with the present invention is that it prevents the unauthorized removal of a computer installed in a public location, such as a gas station or convenience store.

Another technical advantage achieved with the present invention is that it prevents unauthorized personnel from tampering with a computer installed in a public location.

Another technical advantage achieved with the present invention is that it enables a computer to be physically secured to a surface without requiring the computer's chassis to be opened.

Another technical advantage achieved with the present invention is that it enables a computer to be physically secured to a surface without the necessity of attaching a cable to the computer.

DETAILED DESCRIPTION OF THE PREFERRED EMBODIMENT

Figure 1:
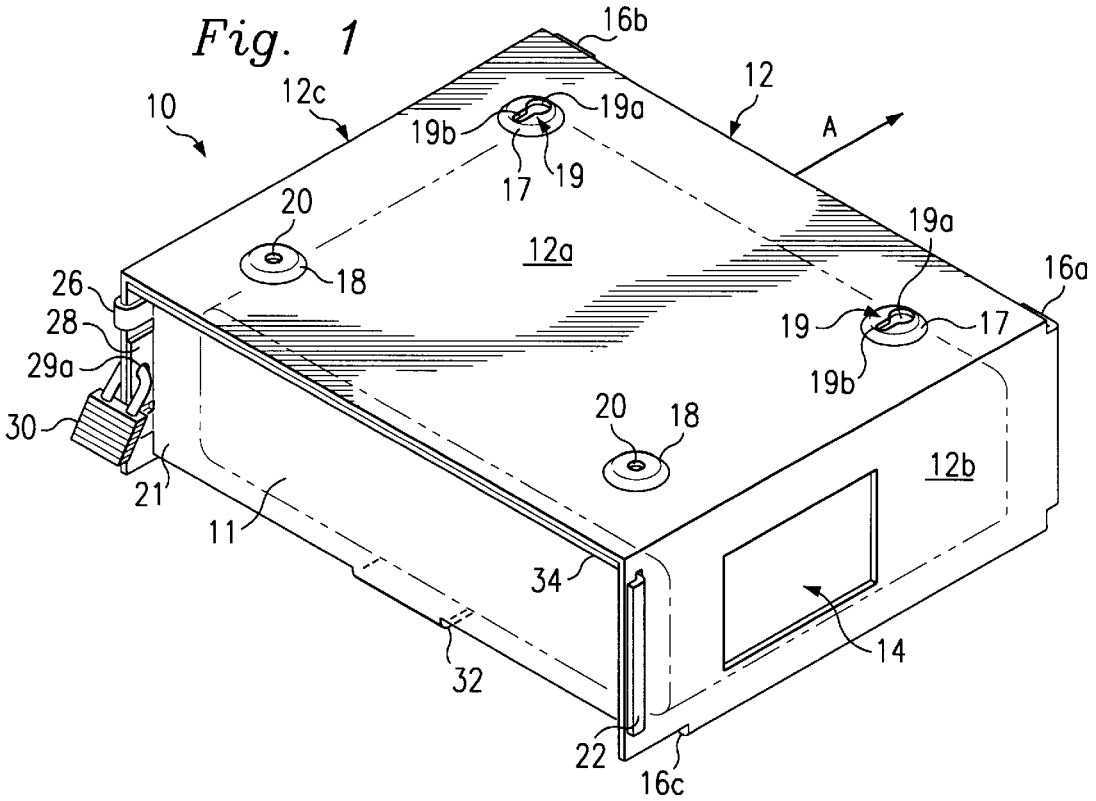
FIG. 1 is a perspective view of a computer security apparatus embodying features of the present invention.
Figure 3:
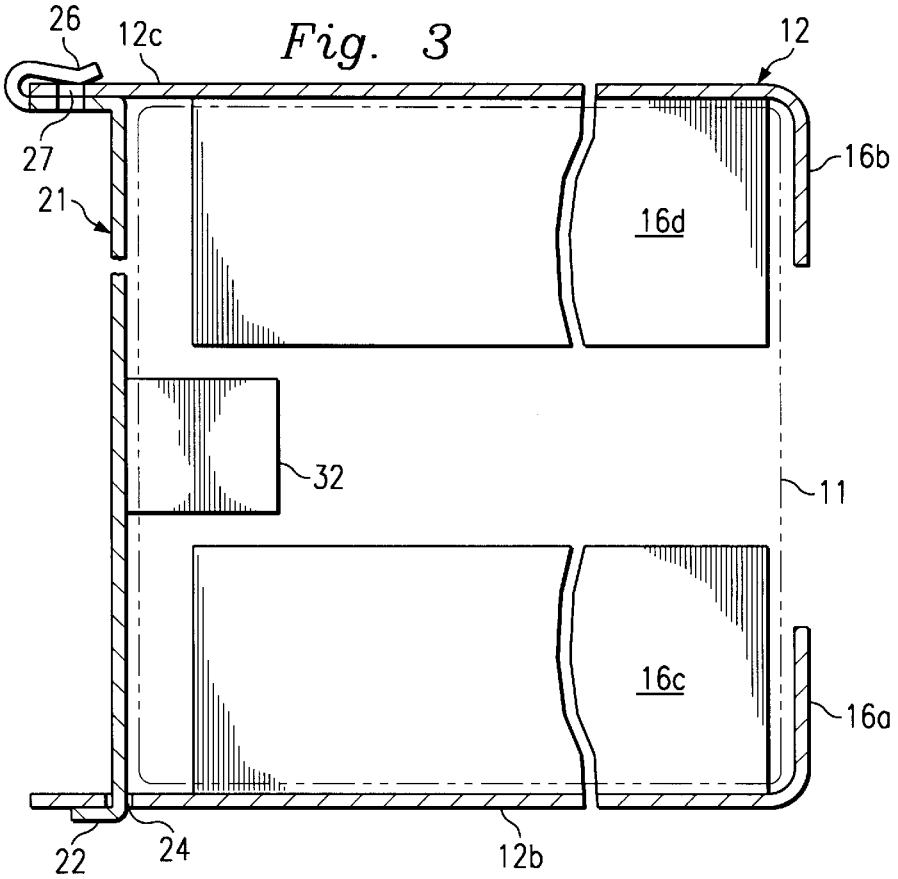
FIG. 3 is a bottom plan view of the apparatus of FIG. 1.

Referring to FIG. 1, reference numeral 10 designates generally a computer security apparatus of the present invention for securely mounting a computer 11 to the underside of a surface (not shown) such as a counter or desk top. The apparatus 10 comprises a metal housing 12 that includes a top 12*a* and opposing left and right sides 12*b* and 12*c* each having a rectangular ventilation opening 14 therethrough. As best shown in FIG. 3, the rear ends of each of the sides 12*b*, 12*c*, are bent toward one another to form flanges 16*a*, 16*b*, each extending approximately one quarter of the way across the back of the housing 12 to secure the computer 11 within the housing 12 at the rear thereof while simultaneously providing the rear of the computer with additional ventilation. In addition, this enables electrical connections between the computer and external peripheral devices, such as a monitor and a printer, to be maintained. Similarly, a portion of the bottom edge of each of the sides 12*b*, 12*c*, are bent toward one another to form flanges 16*c*, 16*d*, extending approximately one third of the way across the bottom of the housing 12 for supporting the bottom of the computer 11 within the housing and providing additional ventilation for the computer.

Referring again to FIG. 1, a mounting apparatus comprising first and second pairs of circular protuberances 17, 18, is provided on the outer surface of the top 12*a* of the housing 12 for use in mounting the apparatus 10 to the underside of a surface (not shown) as described below. In particular, each of the protuberances 17 has a slotted opening 19 therethrough comprising a circular section 19*a* and an elongated section 19*b*. Each of the protuberances 18 has a thread clearance bore 20 drilled therethrough. To mount the apparatus 10 to the underside of the surface, the heads of two screws that have been partially screwed into the underside of the surface are respectively passed through the circular portions 19*a* of the openings 19 and the apparatus 10 is then moved in the direction of an arrow A such that the bodies of the screws now pass into the elongated portion 19*b* of the openings 19, at which point the elongated portions 19*b* retain the heads of the screws within the protuberances 17. Once the apparatus 10 has been properly positioned as just described, additional screws (not shown) are screwed through the thread clearance bores 20 into the underside of the surface to secure the apparatus 10 in place. In the preferred embodiment, the protuberances are sufficiently deep to prevent the screw heads from projecting into the housing 12.

Figure 2:
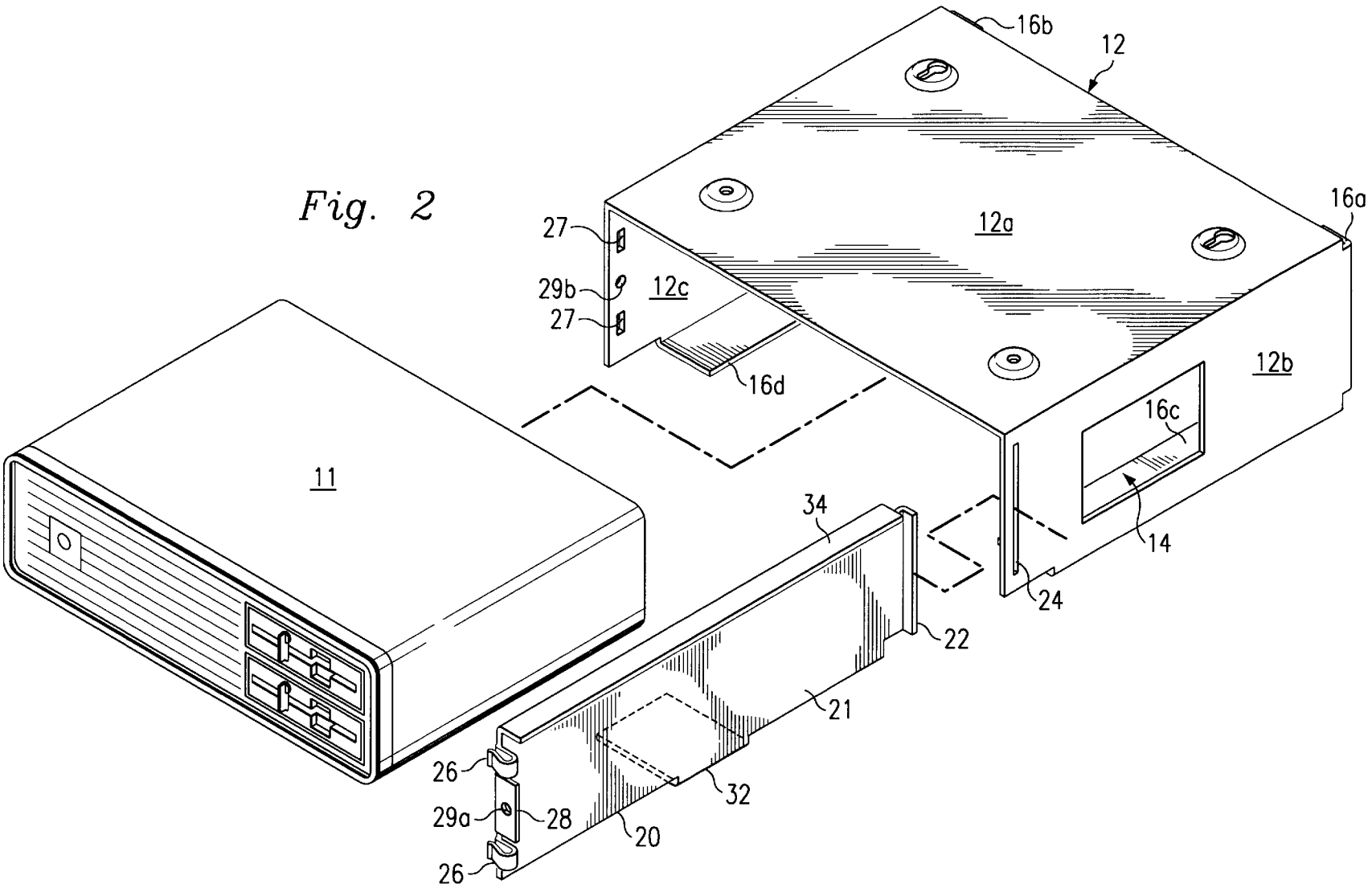
FIG. 2 is an exploded view of the apparatus of FIG. 1 illustrating installation of a computer therein.

Referring to FIG. 2, a door 21 is hingedly connected across the front of the housing 12 in the following manner. The door 21 includes a forwardly projecting flange 22 at one end thereof for insertion into an elongated aperture 24 designed to receive the flange 22 disposed proximate the front edge of the side 12*b*. Two spaced-apart resilient clips 26 are provided along the opposite end of the door 21 for securing the door to the front end of the side 12*c*. In a preferred embodiment, corresponding apertures 27 are provided along the front end of the side 12*c* for securely receiving the clips 26. A forwardly projecting flange 28 is provided between the clips 26 and has a circular aperture 29*a* therethrough. A corresponding circular aperture 29*b* is provided at the front end of the side 12*c* such that when the door 21 is closed, a padlock 30 (FIG. 1) may be passed through the apertures 29*a*, 29*b*, for locking the door 21 to the housing 12. A rearwardly projecting flange 32 is provided along the bottom edge of the door 21 for prevention of access to power and reset switches when the door 21 is closed. A forwardly flange 34 that extends substantially the length of the top edge of the door 21 is provided to prevent access to the computer 11 via any space that may otherwise exist between the top edge of the door 21 and the front edge of the top 12*a*.

Referring now to FIG. 3, the relative positions of the flange 22, aperture 24, clips 26 and apertures 27 are such that when the door 21 is closed across the front of the housing 12, it is at least slightly recessed into the housing, while the flange 34 extends to the front edge of the top 12*a* of the housing 12 for further assisting in preventing unauthorized access to the computer 11 via any gap that may otherwise exist between the top of the door 21 and the front edge of the top 12*a* of the housing 12.

Accordingly, using the apparatus 10 as shown and described herein, a computer, such as the computer 11, may be securely mounted to the underside of a surface, such as a counter or desktop, in a manner such that the computer cannot be removed or tampered with by unauthorized persons. Typically, the apparatus 10 will be semi-permanently installed under a counter such that a computer, such as the computer 11, may be inserted and removed by a person possessing a key (not shown) corresponding to the padlock 30.

Although illustrative embodiments of the present invention have been shown and described, a latitude of modification, change and substitution is intended in the foregoing disclosure, and in certain instances, some features of the invention will be employed without a corresponding use of other features. For example, rather than being mounted to the underside of a surface, the apparatus 10 may be mounted to the side of a surface, such that the computer 11 rests on its side within the housing 12. Accordingly, it is appropriate that the appended claims be construed broadly and in a manner consistent with the scope of the invention.

What is claimed is:

1. Apparatus for securing an electrical device to a mounting surface, the apparatus comprising:

a top side comprising means for mounting said apparatus to said mounting surface;

first and second opposing sides each having a bottom flange and a rear flange extending inwardly toward the other opposing side;

a door removably connected at a first end thereof to said first opposing side and having a first aperture therethrough at a second end thereof, said first aperture being positioned such that, when said door is in a closed position, said first aperture is aligned with a second aperture disposed through said second opposing side for receiving a padlock therethrough for locking said door in said closed position.

2. The apparatus of claim 1 wherein said mounting means further comprises:

a first protuberance having a slotted aperture therethrough, said slotted aperture comprising a circular portion for receiving a head of a first screw within said first protuberance and an elongated portion for retaining said first screw head within said first protuberance when said apparatus is moved from a first position relative to said mounting surface to a second position relative to said mounting surface; and a second protuberance having a threaded bore therethrough for receiving a second screw for securing said apparatus in said second position relative to said mounting surface.

3. The apparatus of claim 1 further comprising at least one ventilation opening in each of said first and second opposing sides.

4. The apparatus of claim 1 wherein said door further comprises a forwardly projecting flange extending substantially the length of said first end of said door and said first opposing side comprises an elongated slot for receiving said forwardly projecting flange for rotatably connecting said first end of said door to said first opposing side.

5. The apparatus of claim 1 wherein said door further comprises a rearwardly projecting flange disposed along a bottom edge of said door for prevention of access to power and reset switches in front of a computer from underneath.

6. The apparatus of claim 1 further comprising a forwardly projecting flange disposed along a top edge of said door for preventing access to said electrical device through a space between said door and said top side.

7. The apparatus of claim 1 wherein said door is recessed into said apparatus in said closed position.

8. The apparatus of claim 1 wherein said electrical device is a computer.

9. The apparatus of claim 1 wherein said door lies in a plane that is perpendicular to said top side.

10. Apparatus for securing an electrical device to a mounting surface, the apparatus comprising:

a top side comprising means for mounting said apparatus to said mounting surface;

first and second opposing sides each having a bottom flange and a rear flange extending inwardly toward the other opposing side;

a door removably connected at a first end thereof to said first opposing side and having a first aperture therethrough at a second end thereof, said first aperture being positioned such that, when said door is in a closed position, said first aperture is aligned with a second aperture disposed through said second opposing side for receiving a padlock therethrough for locking said door in said closed position:

wherein said door further comprises spaced-apart resilient clips disposed along said second end of said door for receiving therein a front edge of said second opposing side for further securing said door to said second opposing side.

11. The apparatus of claim 10 wherein said second opposing side further comprises apertures disposed near said front edge thereof corresponding to said clips for receiving a portion of said clips.

12. Apparatus for preventing unauthorized access to a computer, the apparatus comprising:

means for mounting said apparatus to a mounting surface;

first and second opposing sides each comprising a bottom flange and a rear flange projecting toward the other opposing side;

a door having first and second ends, said first end of said door being rotatably connected to a forward end of said first opposing side; and means for securing said second end of said door to a forward end of said second opposing side.

13. The apparatus of claim 12 wherein said mounting means further comprises:

a first pair of protuberances each having a slotted aperture therethrough, said slotted aperture comprising a circular portion and an elongated portion; and a second pair of protuberances each having a threaded bore therethrough.

14. The apparatus of claim 12 further comprising at least one rectangular ventilation opening in each of said first and second opposing sides.

15. The apparatus of claim 12 wherein said door further comprises a forwardly projecting flange extending substantially the length of said first end of said door and said first opposing side comprises an elongated slot for receiving said forwardly projecting flange for rotatably connecting said first end of said door to said first opposing side.

16. The apparatus of claim 12 wherein said door further comprises a rearwardly projecting flange disposed along a bottom edge of said door for supporting the bottom of said computer when said door is in a closed position.

17. Apparatus for preventing unauthorized access to a computer, the apparatus comprising:

means for mounting said apparatus to a mounting surface;

first and second opposing sides each comprising a bottom flange and a rear flange projecting toward the other opposing side;

a door having first and second ends, said first end of said door being rotatably connected to a forward end of said first opposing side; and means for securing said second end of said door to a forward end of said second opposing side, said securing means comprising:

a forwardly projecting flange disposed at said second end of said door and having a first circular aperture therethrough, said first circular aperture being positioned such that when said door is in a closed position, said first circular aperture is aligned with a second circular aperture disposed proximate said forward end of said second opposing side;

a pair of spaced-apart resilient clips disposed at said second end of said door for receiving said forward end of said second opposing side;

a pair of spaced-apart apertures disposed proximate said forward end of said second opposing side for receiving a portion of said spaced-apart resilient clips; and wherein a padlock may be removably disposed through said first and second apertures for locking said door in said closed position.

18. Apparatus for securing a computer to a mounting surface, the apparatus comprising:

a top side comprising means for mounting said apparatus to said mounting surface, said mounting means comprising:

a first pair of protuberances each having a slotted aperture therethrough, said slotted aperture comprising a circular portion and an elongated portion; and a second pair of protuberances each having a threaded bore therethrough;

first and second opposing sides, each of said opposing sides comprising a bottom flange along a bottom edge thereof and a rear flange along a rear edge thereof, each of said bottom and rear flanges extending inwardly toward the opposite side for retaining said computer within said apparatus;

a door disposed across a front side of said apparatus, said door comprising:

a first forwardly projecting flange extending substantially the length of a first end of said door for insertion into an elongated slot disposed proximate a forward edge of said first opposing side for rotatably connecting said first end of said door to said first opposing side; and a pair of spaced-apart resilient clips disposed along a second end of said door for receiving a forward edge of said second opposing side for securing said door to said second opposing side; and a locking mechanism for locking said second end of said door to said forward edge of said second opposing side.

19. The apparatus of claim 18 wherein said locking mechanism comprises:

a second forwardly projecting flange disposed between said spaced-apart clips, said second forwardly projecting flange comprising a first circular aperture positioned such that, when said door is in a closed position, said first circular aperture is aligned with a second circular aperture disposed near said forward edge of said second opposing side; and a padlock disposed through said first and second circular apertures for locking said second end of said door to said second opposing side.

20. The apparatus of claim 18 further comprising at least one ventilation opening in each of said first and second opposing sides.

21. The apparatus of claim 18 wherein said second opposing side further comprises apertures disposed near said forward edge thereof for receiving a portion of said spaced-apart clips.

22. The apparatus of claim 18 wherein said door further comprises a rearwardly projecting flange disposed along a bottom edge of said door.

23. The apparatus of claim 18 wherein said door further comprises a forwardly projecting flange disposed along a top edge thereof for preventing access to said computer along said top edge of said door when said door is in a closed position.

24. Apparatus for preventing unauthorized access to a computer, the apparatus comprising:

means for mounting said apparatus to a mounting surface;

first and second opposing sides each comprising a bottom flange and a rear flange projecting toward the other opposing side;

a door having first and second ends, said first end of said door being rotatably connected to a forward end of said first opposing side; and means for securing said second end of said door to a forward end of said second opposing side, wherein said means for mounting is disposed on a top surface of said apparatus and wherein said door extends across a front side of said apparatus and wherein said front side is perpendicular to said top surface.

* * * * *